United States Patent [19]

Kanaga et al.

[11] 4,290,546

[45] Sep. 22, 1981

[54] COVER FOR FOOD SERVING DISHES

[76] Inventors: Amos R. Kanaga; Stephen R. Kanaga, both of 2300 Palm Ave., San Mateo, Calif. 94403

[21] Appl. No.: 73,020

[22] Filed: Sep. 6, 1979

[51] Int. Cl.[3] ..... B65D 5/64; B65D 43/06

[52] U.S. Cl. ..... 229/43

[58] Field of Search ..... 229/43

[56] References Cited

U.S. PATENT DOCUMENTS

| | | | |
|---|---|---|---|
| 1,612,166 | 12/1926 | Baldwin | 229/43 X |
| 2,944,725 | 7/1960 | Hayes | 229/43 |
| 2,951,765 | 9/1960 | Robson | 229/3.5 MF UX |
| 2,970,735 | 2/1961 | Jacke et al. | 229/45 X |
| 3,337,116 | 8/1967 | Nowak | 229/45 |
| 3,531,298 | 9/1970 | Donahue | 229/43 X |
| 4,089,417 | 5/1978 | Osborne | 229/43 X |

FOREIGN PATENT DOCUMENTS

| | | | |
|---|---|---|---|
| 549247 | 11/1957 | Canada | 229/36 |

*Primary Examiner*—Davis T. Moorehead
*Attorney, Agent, or Firm*—Phillips, Moore, Weissenberger, Lempio & Majestic

[57] ABSTRACT

A cover for use with disposable plates, platters or other dishes of the type used by the "take-out" food industry is disclosed. The cover comprises a sheet of semi-rigid material such as paperboard having an area large enough to overlie the dish and is attached thereto by means of at least two slits through the sheet spaced from each other and dimensioned to each receive a substantial portion of the periphery of the dish thereby holding the cover in engagement with the upper surface of the dish to protect food thereon from contamination while tending to maintain the food at serving temperature.

4 Claims, 6 Drawing Figures

COVER FOR FOOD SERVING DISHES

FIELD OF THE INVENTION

This invention relates to covers or lids for food serving dishes such as plates, platters, trays and the like and particularly to an improved disposable cover for "take-out" food containers in the form of dishes as distinguished from boxes or cartons.

BACKGROUND OF THE INVENTION

In the "take out" food industry the containers in which the food is served are usually made of paper or plastic materials intended for convenient disposal after use. It is known to make such containers in box or carton form of substantial depth with an integral lid or top cover designed for closure after the food is placed therein.

However, heretofore there has been no satisfactory cover for food placed on shallow disposable food serving dishes such as the plates, platters or trays used in the "take out" food industry. It is known to place the "take out" food on a first disposable plate, platter or tray, for example, and then affix an identical or similar plate, platter or tray upside down on top of the first over the food, using staples or a similar attachment means. This is unsatisfactory or dangerous, or both, since unless the attachment means is fairly rugged, it will not provide adequate attachment to protect the food, whereas, if the attachment means is fairly rugged, it will be difficult to release and once released may fall into the food for accidental consumption since it is a separable item.

It is a primary object of this invention to provide a separate, simple, yet effective cover for food serving dishes that is strong and durable when used for either hot or cold foods but which may be inexpensively manufactured for convenient use with existing food serving dishes.

SUMMARY OF THE INVENTION

A cover for a food serving dish having food thereon according to this invention comprises a sheet of semi-rigid material having transverse peripheral dimensions larger than the transverse peripheral dimensions of the dish and at least two spaced slits therethrough. Each of the slits have a length sufficient to receive a substantial portion of the periphery of the dish. The mid-points of the slits are spaced from each other by a distance which is less than a given transverse peripheral dimension of the dish and corresponding ends of said slits are spaced from each other by a distance which is greater than transverse peripheral dimensions of the dish on opposite sides of said given peripheral dimension.

BRIEF DESCRIPTION OF THE DRAWING

This invention will be more fully understood from the following detailed description of preferred embodiments thereof when read in conjunction with the accompanying drawing wherein.

DETAILED DESCRIPTION OF PREFERRED EMBODIMENTS

Figure 1:
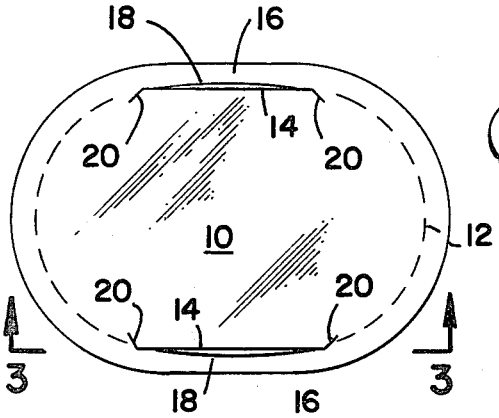
FIG. 1 is a top plan view of a cover according to one embodiment of this invention as applied to a platter the periphery of which is indicated partially in dotted lines where it lies beneath the cover and partially in solid lines where it projects through slits provided in the cover.

Referring to FIG. 1, a cover 10 according to one embodiment of the teaching of this invention is shown in top plan view overlying a platter 12 the outer periphery of which is indicated in part by dotted lines. The cover 10 has a pair of slits 14 cut therethrough and a portion of the outer periphery of the platter 12 is shown projecting therethrough by solid lines.

Figure 2:
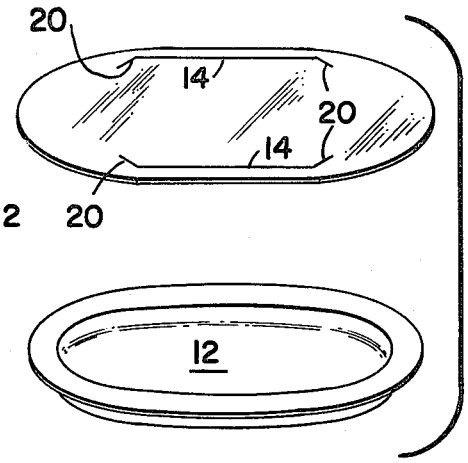
FIG. 2 is an exploded perspective view of the cover and platter of FIG. 1.

Referring to FIG. 2, the cover 10 and platter 12 are shown in perspective prior to being assembled together. As shown in FIG. 2, the platter 12 is oval shaped having some depth and a lip about its outer periphery. However, this invention is equally applicable to plates, saucers, bowls or trays used for serving portions of food to be consumed by an individual which are generally included under the broad category of dishes and the word "dish" or "dishes" is used herein in its broad sense.

Dishes for use in the fast food industry are usually made of paper or plastic materials. Such dishes are made in a wide variety of sizes generally of circular or oval shape and of small depth by comparison to their area. Portions of one or more kinds of food are placed on the dish for serving to a given individual. Where the dish with food portions thereon is to be removed from the premises for consumption of the food by the individual, there is a need for a simple, inexpensive and effective cover to be placed over the food and attached to the dish to protect the food from contamination and help to maintain it at serving temperature.

According to this invention, the cover 10 comprises a flat sheet of semi-rigid material, such as paperboard, for example, which may be die cut to the approximate shape of the platter 10 but having larger transverse peripheral dimensions than the corresponding transverse peripheral dimensions of the platter 12. A pair of spaced slits 14 are provided through the paperboard cover 10 preferably by die cutting. Such slits 14 have a length sufficient to receive a substantial portion of the periphery of the platter 12. According to the preferred embodiment of this invention as shown in FIG. 1, the mid points of the slits 14 define a line overlying the center of the area of the platter 12, with the spacing between such mid points being less than the transverse peripheral dimension of the platter 12 along such line. The slits 14 shown in FIG. 1 are rectilinear and the corresponding end points of the slits 14 are spaced from each other by a distance greater than the transverse peripheral dimension of the platter 12 on the line defined by such end points.

Figure 3:
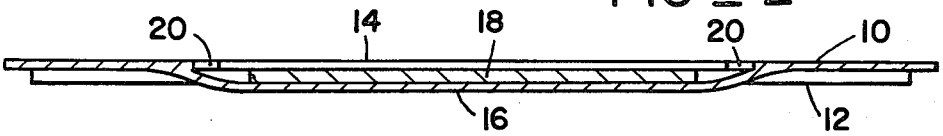
FIG. 3 is an enlarged fragmentary cross-sectional view taken along line 3—3 of FIG. 1.

Thus, as best shown in FIG. 3, the portion 16 of the cover 10 exterior of the slits 14 may be deflected downwardly so that a portion 18 of the periphery of the platter 12 is received through the slit 14 and projects over the portion 16 of the cover 10. Since the cover 10 is made of semi-rigid paperboard material, the peripheral portions 18 of the platter 12 will be compressively retained in the slits 14 to hold the cover 10 firmly against the uppermost surface of the platter 12.

We have found it important and necessary to provide each slit 14 with an extension 20 at each end thereof extending inwardly at an included angle of about 135° with respect to the slit. Without such extensions, the spacing between the slits 14 would have to be precise for each size dish or platter 12 to which the cover 10 is to be applied and would tend to give a loose fit. The extensions 20 provide for some latitude in the curvature of the plate or platter to which the cover is applied and in addition, provides a locking action tending to hold the cover 10 securely on the platter 12.

Figure 4:
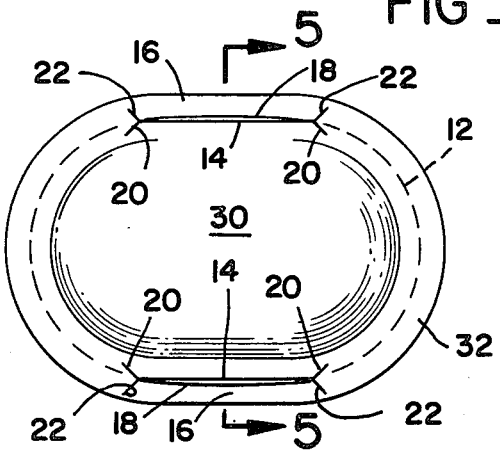
FIG. 4 is a top plan view similar to FIG. 1, but of a cover according to another embodiment of this invention.
Figure 5:
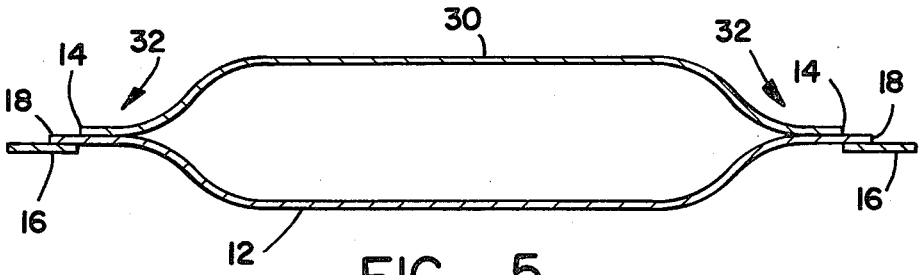
FIG. 5 is an enlarged cross-sectional view taken along line 5—5 of FIG. 4.

Referring to FIGS. 4 and 5, a cover 30 according to a further embodiment of this invention is shown. In this embodiment of the invention the central portion of the cover 30 is embossed to form a cup-like cavity corresponding generally to the shape of the depth of the plate or platter 12. This will enable the cover 30 to accommodate food portions which project above the plane of the upper surface of the platter 12. The outer periphery of the cover 30 provides a flat rim 32 in which the slits 14 are cut as described in connection with FIGS. 1–3. Thus the cover 30 may be identical to the cover 10 with the exception of the fact that its central portion is embossed to provide the cup-like cavity.

However, as best shown in FIG. 4, the slits 14 may each be provided with a further extension 22 extending outwardly at an included angle of about 135° with respect to the slit 14. Thus the included angle between the extensions 20 and 22 at each end of the slits 14 is about 90°. The combination of such extensions 20 and 22 facilitates the fastening of the cover to the dish while reducing the possibility of tearing at the ends of the slits 14 and allowing the slits 14 to accommodate dishes of various wall thickness. Dishes used in the fast food industry are made of a variety of conventional materials such as paper, paperboard and plastic including styrofoam which may be of various thicknesses. Thus, the extensions 20 and 22 in combination will not only accommodate variations in curvature and thickness but will also provide a secure locking action with reduced danger of tearing and increased convenience.

Figure 6:
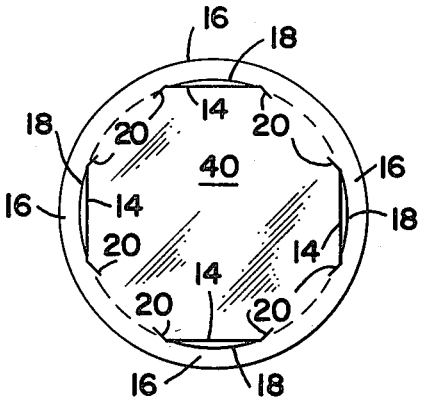
FIG. 6 is a top plan view similar to FIGS. 1 and 4 but of a further embodiment of this invention.

Referring to FIG. 6, a cover 40 according to the teaching of this invention for use with a plate, platter or dish 42 having a circular periphery is shown. As shown in FIG. 6, four slits 14 according to the teaching of this invention are provided in the cover 40 with their mid-points spaced from each other by 90° about the periphery of the circular dish 42. It would also be possible to use three slits 14 having their mid-points spaced from each other by 120° about the periphery of the dish 42. Obviously, it would also be possible to use five or more slits 14 evenly shaped about the periphery of the dish 42.

However, according to this invention, a smaller number of slits 14 of greater length is preferred. Thus as shown in FIGS. 1 and 4, a pair of slits including locking extensions 20 and 22 are sufficient to hold the cover firmly in place on a dish of oval shape where the slits are located to receive the long sides of the oval having minimum curvature. Such slits may have substantially greater length than slits located to receive the shorter sides of the oval having maximum curvature with a corresponding increase in the security of the attachment of the cover.

Where the cover, according to this invention, is made of paperboard, a moisture resistant coating may be applied to one surface which may be placed next to the food as is known in the art so that the steam and moisture from hot foods will not affect the rigidity of the cover. Furthermore, a cover according to this invention may be made of any conventional material used in the art such as paper, pressboard, plastic including styrofoam, or even foil laminated to a sheet or annular rim of paperboard, for example.

The cover according to this invention need not have a peripheral shape corresponding to the dish to which it is applied. Thus, a rectangular cover could be applied to an oval dish or a square cover could be applied to a circular dish. Similarly, it is only necessary that the cover overlap the dish by an amount sufficient to protect the food thereon from contamination while allowing the attachment of the cover to the dish in accordance with the teaching of this invention. Thus, the cover must extend beyond the periphery of the dish at the slits as shown in the drawing but need not so extend about the entire periphery of the dish.

It is believed that those skilled in the art will make obvious modifications to the preferred embodiments of this invention without departing from the teaching of this invention as set forth herein and in the following claims. For example, the extensions 20 and 22 at the ends of the slits 14 may be used selectively, depending upon the curvature of the dish and its wall thickness with greater curvature and greater wall thickness tending to dictate the use of the combination of extensions 20 and 22. The slits 14 need not be rectilinear in all embodiments of this invention but may have some curvature and in addition, the slits 14 may take the form of slots having some transverse dimensions if necessary or desirable.

What is claimed is:

1. A cover for a food serving dish, said cover comprising a sheet of semi-rigid material selected from the group consisting of paper, paperboard, pressboard and plastic having transverse peripheral dimensions larger than corresponding transverse peripheral dimension of said dish, said dish having a pair of opposed arcuate peripheral edges of given length with the midpoints thereof spaced from each other by a given transverse peripheral dimension taken through the center of the area of said dish, said cover having a pair of substantially parallel rectilinear slits therethrough, said slits each having a length approaching said given length of said arcuate peripheral edges of said dish with the midpoints of said slits spaced from each other by a distance less than said given transverse peripheral dimension of said dish and corresponding ends of said slits being spaced from each other by a distance which is greater than corresponding transverse peripheral dimension of said dish on opposite sides of given transverse peripheral dimension of said dish, each said slit having an inwardly extending rectilinear extension at each end thereof forming an included angle of about 135° with respect to said slit.

2. A cover for a food serving dish as claimed in claim 1 wherein each of said slits is provided with an outwardly extending rectilinear extension at each end thereof forming an included angle of about 135° with respect to said slit.

3. A cover for a food serving dish as claimed in claim 1 wherein said cover comprises a sheet of foil laminated on said semi-rigid sheet.

4. A cover for a food serving dish as claimed in claim 1 wherein an interior portion of said sheet of semi-rigid material is embossed to provide a hollow cavity.

* * * * *